US007019290B2

(12) United States Patent
Hager et al.

(10) Patent No.: US 7,019,290 B2
(45) Date of Patent: Mar. 28, 2006

(54) SYSTEM AND METHOD FOR MODIFYING THE FRINGING FIELDS OF A RADIO FREQUENCY MULTIPOLE

(75) Inventors: James W. Hager, Mississauga (CA); Frank A. Londry, Peterborough (CA)

(73) Assignees: Applera Corporation, Norwalk, CT (US); MDS Inc., Concord (CA)

( * ) Notice: Subject to any disclaimer, the term of this patent is extended or adjusted under 35 U.S.C. 154(b) by 54 days.

(21) Appl. No.: 10/448,376

(22) Filed: May 30, 2003

(65) Prior Publication Data

US 2004/0238734 A1 Dec. 2, 2004

(51) Int. Cl.
*H01J 49/40* (2006.01)
*H01J 49/42* (2006.01)

(52) U.S. Cl. ..... 250/292; 250/282

(58) Field of Classification Search ..... 250/281, 250/282, 287, 288, 290, 292, 396 ML
See application file for complete search history.

(56) References Cited

U.S. PATENT DOCUMENTS 2,939,952 A * 6/1960 Helmut et al. ..... 250/292
3,617,736 A * 11/1971 Barnett et al. ..... 250/290
3,699,330 A * 10/1972 McGinnis ..... 250/290
5,179,278 A * 1/1993 Douglas ..... 250/290
5,206,506 A * 4/1993 Kirchner ..... 250/281
5,572,035 A * 11/1996 Franzen ..... 250/396 R
5,576,540 A * 11/1996 Jolliffe ..... 250/292
5,689,111 A * 11/1997 Dresch et al. ..... 250/287
5,767,513 A * 6/1998 Dressler et al. ..... 250/292
5,847,386 A * 12/1998 Thomson et al. ..... 250/288
5,942,752 A * 8/1999 Wang ..... 250/288
6,020,586 A * 2/2000 Dresch et al. ..... 250/287
6,028,308 A * 2/2000 Hager ..... 250/282
6,075,244 A * 6/2000 Baba et al. ..... 250/292
6,093,929 A * 7/2000 Javahery et al. ..... 250/282
6,111,250 A * 8/2000 Thomson et al. ..... 250/282
6,114,691 A * 9/2000 Cousins ..... 250/282
6,177,668 B1 * 1/2001 Hager ..... 250/282
6,194,717 B1 * 2/2001 Hager ..... 250/292
6,417,511 B1 * 7/2002 Russ et al. ..... 250/292
6,483,109 B1 * 11/2002 Reinhold et al. ..... 250/292
6,504,148 B1 * 1/2003 Hager ..... 250/282
6,525,312 B1 * 2/2003 Cousins ..... 250/281
6,528,784 B1 * 3/2003 Tang et al. ..... 250/282

(Continued)

OTHER PUBLICATIONS

Dawson, P.H., ed. "Fringing Fields and Other Imperfections" in Quadrupole Mass Spectrom., Elsevier, Amsterdam, 1976, pp. 95-119.

(Continued)

*Primary Examiner*—John R. Lee
*Assistant Examiner*—David A. Vanore
(74) *Attorney, Agent, or Firm*—Bereskin & Parr

(57) ABSTRACT

A system and method are described for producing a modifiable fringing field in a multipole instrument, such as a mass spectrometer or an ion guide. The system includes a conductor arrangement having a first pole pair, a second pole pair and an end device for allowing ions to enter or exit the conductor arrangement. A first power supply provides a first voltage to the first pole pair, such that the application of the first voltage results in a fringing field near the end device. An end device power supply provides an end device voltage to the end device for modifying the fringing field to facilitate the entrance or exit of the ions.

46 Claims, 8 Drawing Sheets

U.S. PATENT DOCUMENTS

| | | | | |
|---|---|---|---|---|
| 6,534,764 | B1 * | 3/2003 | Verentchikov et al. | 250/287 |
| 6,700,116 | B1 * | 3/2004 | Taniguchi | 250/282 |
| 6,700,120 | B1 * | 3/2004 | Hager | 250/292 |
| 6,703,607 | B1 * | 3/2004 | Stott et al. | 250/282 |
| 6,713,757 | B1 * | 3/2004 | Tanner et al. | 250/288 |
| 6,720,554 | B1 * | 4/2004 | Hager | 250/282 |
| 6,723,986 | B1 * | 4/2004 | Kernan et al. | 250/292 |
| 6,744,043 | B1 * | 6/2004 | Loboda | 250/287 |
| 6,797,950 | B1 * | 9/2004 | Schwartz et al. | 250/292 |
| 6,815,667 | B1 * | 11/2004 | Tanner et al. | 250/281 |
| 6,815,673 | B1 * | 11/2004 | Plomley et al. | 250/292 |

OTHER PUBLICATIONS

Hager, James W., "Performance Optimization and Fringing Field Modifications of a 24-mm Long RF-only Quadrupole Mass Spectrometer", Rapid Communications in Mass Spectrometry, 13, 740-747 (1999).

Hunter, Kevin L. and Bruce J. McIntosh, "An Improved Model of the Fringing Fields Of A Quadrupole Mass Filter", International Journal of Mass Spectrometry and Ion Processes, 87 (1989) 157-164.

* cited by examiner

SYSTEM AND METHOD FOR MODIFYING THE FRINGING FIELDS OF A RADIO FREQUENCY MULTIPOLE

FIELD OF THE INVENTION

This invention relates to mass spectrometers and ion guides, and more specifically relates to radio frequency multipole mass spectrometers and ion guides.

BACKGROUND OF THE INVENTION

Mass spectrometry is a powerful tool for identifying analytes in a sample. Applications are legion and include identifying biomolecules, such as carbohydrates, nucleic acids and steroids, sequencing biopolymers such as proteins and saccharides, determining how drugs are used by the body, performing forensic analyses, analyzing environmental pollutants, and determining the age and origins of specimens in geochemistry and archaeology.

In mass spectrometry, a portion of a sample is transformed into a gas containing analyte ions. The gaseous analyte ions are separated in the mass spectrometer according to their mass-to-charge (m/z) ratios and then detected by a detector. In the detector, the ion flux is converted to a proportional electrical current. The mass spectrometer records the magnitude of these electrical signals as a function of m/z and converts this information into a mass spectrum that can be used to identify the analyte.

For example, in quadrupole mass spectrometers, a time-dependent electric field, which is generated by applying appropriate voltages to an arrangement of conductors, exerts forces on ions near the conductors. The trajectories of the ions depend on their m/z ratio. By choosing appropriate voltages, ions injected in the space between the conductors having m/z values that fall in a small interval centered about a particular m/z are transmitted and then detected by a detector. Other ions having m/z values falling outside this interval are filtered out without being detected.

One common arrangement of electrodes is that of a quadrupole spectrometer comprising four parallel rods and two end devices, such as end plates or lenses. Various voltages can be applied to the rods and end plates. For example, both pairs of rods can be subjected to an RF voltage and a DC voltage (RF/DC mass spectrometer), or both pairs of rods can be subjected to only an RF voltage (RF-only mass spectrometer). Applying a DC voltage to the end plates traps the ions, before a portion are ejected for detection (ion trap mass spectrometer). Similar systems can also be used as ion guides. In addition to trapping ions in ion trap mass spectrometers, the end plates also generally serve to terminate the fields arising from the quadrupole rods.

The electric field of an ideal arrangement of infinitely long rods in the absence of end plates yields a relatively simple electrical field. In particular, when the four rods are disposed on the edges of a box and RF fields are applied to the rods so that opposite edges are in phase and adjacent edges are out of phase by 180°, a quadrupolar field arises. However, the finite length of the rods and the presence of the end plates in laboratory mass spectrometers give rise to non-ideal behavior. In particular, penetration of the end fields into the axial region of the quadrupole rods causes a local distortion of the ideal quadrupolar field and gives rise to a fringing field that is most prominent near the entrance plate and the exit plate.

Thus, in a multipole mass spectrometer or ion guide, ions in the vicinity of the end plates experience fields that are not entirely quadrupolar, due to the nature of the termination of the main RF and DC fields near the entrance and exit plates. Fringing fields couple the radial and axial degrees of freedom of the trapped ions. In contrast, near the center of the rod arrangement, further removed from the end plates and fringing fields, the axial and radial components of ion motion are not coupled or are minimally coupled.

The fringing fields couple the radial and axial degrees of freedom of the trapped ions. In certain ion trap mass spectrometers, this fact can be exploited to eject ions axially, as described in U.S. Pat. No. 6,177,668, the contents of which are herein incorporated by reference. In particular, in a quadrupolar rod configuration with end plates, ions can be trapped, and then, by scanning the frequency of a low voltage auxiliary AC field, ions of a particular m/z value can be axially ejected out of the trap for detection.

The auxiliary AC field is an addition to the trapping DC voltage supplied to end plates and couples to both radial and axial secular ion motion. The auxiliary AC field is found to excite the ions sufficiently that they surmount the axial DC potential barrier at the exit plate, so that they can leave axially. The deviations in the field in the vicinity of the exit plate leads to the above-described coupling of axial and radial ion motions. This coupling enables the axial ejection of ions at radial secular frequencies, which ions may then be analyzed according to the usual techniques of mass spectrometry. In contrast, in a conventional ion trap, excitation of radial secular motion generally leads to radial ejection, and excitation of axial secular motion generally leads to axial ejection.

This use of the fringing fields to axially eject ions from ion traps for mass analysis, as well as the role of these fields in RF/DC and RF-only mass spectrometers, underscores the importance of understanding and controlling the fringing fields.

These fringing fields play a large role in the performance of multipole mass spectrometers. Entrance fringing fields can significantly change the ion acceptance properties of RF/DC quadrupole mass spectrometers and these fringing fields have been studied by several investigators.

Exit fringing fields have been shown to be important for operation of RF-only quadrupole mass spectrometers as well as linear ion trap mass spectrometers with axial ion ejection. In these devices the mechanism of action is intimately tied to the radial-to-axial coupling of the ion motion induced in the exit fringing field region of the multipole.

SUMMARY OF THE PRESENT INVENTION

The fringing fields can be modified by making changes to the RF or DC voltages applied to the rods. For example, the present inventors have realized that changes in the relative amounts of RF voltage on the two pole pairs of a quadrupole rod array can lead to profound changes in both the entrance and exit fringing fields. However, when there is no reference to RF ground the RF voltage ratio between the two pole pairs is irrelevant. This is the case when within the multipole structure sufficiently distant from the rod ends such as in the central section of a linear multipole. There is a reference to RF ground in the entrance and exit fringing fields provided by the entrance and exit lenses. Under these conditions, the relative RF voltage ratio on the pole pairs of the multipole array is meaningful and can strongly affect the performance of multipole ion guides, RF/DC mass spectrometers, RF-only mass spectrometers, and mass selective linear ion trap mass spectrometers.

Further, the inventors have realized that changes in the RF voltage ratio of the two pole pairs of a quadrupole rod array generally affects the entrance and exit fringing fields in the same manner which may not be desirable. Some tandem mass spectrometers, such as the Q TRAP manufactured by AB|MDS SCIEX, employ rod arrays that can be operated as RF/DC quadrupole mass spectrometers and linear ion trap mass spectrometers on alternate scans. For optimum RF/DC mass spectrometer performance it is important to properly tailor the entrance fringing fields, while optimum linear ion trap mass spectrometer performance is obtained by suitably arranged exit fringing fields. It is an unfortunate state of affairs that it is often not possible to optimize the entrance and exit fringing fields simultaneously by simple changes in the relative RF and DC voltages applied to the pole pairs of the rod arrays. Thus, there is a need for a method that allows for independent modifications to the entrance and exit fringing fields of a multipole rod array.

It is therefore desirable to provide a method that allows simultaneous, independent optimization of the entrance and exit fringing fields of a multipole rod array regardless of the RF voltage ratio applied to the pole pairs. It is recognized that in many cases it is desirable to operate the RF voltage in a balanced configuration in order to both transmit and/or trap ions over the greatest ion m/z range. Thus, it is desirable to modify the entrance and exit fringing fields while maintaining the multipole in an RF voltage balanced configuration. This can be accomplished by adding certain fractions of the appropriate phase of RF voltage applied to the rod pole pairs to the entrance and exit lenses at the ends of the multipole rod array. When these additional or auxiliary RF voltages are applied in an independently controllable manner, this approach allows the simultaneous optimization of the entrance fringing field for the best RF/DC quadrupole mass spectrometer performance and optimization of the exit fringing field for the best axial ejection linear ion trap mass spectrometer performance while maintaining the RF voltage applied to the pole pairs in a balanced configuration.

Further, fringing fields can be modified by making changes to the RF or DC voltages applied to the rods. For example, as described in U.S. Pat. No. 6,028,308 by Hager, the contents of which are herein incorporated by reference, changes in the relative amounts of RF voltage on the two pole pairs of a quadrupole rod array can lead to profound changes in the fringing fields, and the present invention, in one aspect, applies this to both the entrance and exit fringing fields. This method for changing the fringing fields can be applied to multipole ion guides, RF/DC mass spectrometers, RF-only mass spectrometers, and mass selective linear ion trap mass spectrometers.

A system and method are described herein for producing a modifiable fringing field in a multipole instrument that includes at least one of an RF/DC mass spectrometer, an ion trap mass spectrometer, and an ion guide. The system includes a multipole rod set having a first pole pair, a second pole pair and an end device for allowing ions to enter or exit the rod set. The system further includes a first power supply for applying a first voltage to the first pole pair, such that the application of the first voltage results in a fringing field near the end device. An end device power supply provides an end device voltage to the end device for modifying the fringing field to facilitate the entrance or exit of the ions.

Also described herein is a system for producing a fringing field in an ion trap mass spectrometer. The system includes a multipole rod set having a first pole pair, a second pole pair and an end device for allowing ions to enter or exit the rod set. The system further includes a first power supply for applying a first voltage to the first pole pair, and a second power supply for applying a second voltage to the second pole pair. An auxiliary power supply provides an auxiliary voltage to the first pole pair to eject ions from an ion trap of the ion trap mass spectrometer. The amplitude of the first voltage is different than the amplitude of the second voltage to thereby produce a fringing field near the end device that facilitates the entrance or exit of the ions.

BRIEF DESCRIPTION OF THE DRAWINGS

For a better understanding of the present invention and to show more clearly how it may be carried into effect, reference will now be made, by way of example, to the accompanying drawings, in which.

DETAILED DESCRIPTION OF THE INVENTION

Before describing a system in accordance with the present invention in detail, some basic principles of the operation of quadrupole devices will be reviewed. However, it is to be appreciated that the invention is, in many aspects, applicable to a variety of multipole instruments, including, for example, hexapoles and octapoles.

During operation of a RF/DC quadrupole, ions tend to become linearly polarized between the rods of the pole of opposite polarity, i.e. for positive ions, this is the pole which carries the negative quadrupolar DC. That is, if the X-pole carries the positive quadrupolar DC, positive ions tend to polarize in the y-z plane. Although this tendency is detectable in the central portion of the quadrupole where the electric field has no axial component, it is manifest most strongly in the fringing regions at the entrance and exit ends of quadrupole arrays.

The behaviour of ions, in response to a combination of RF and DC quadrupole potentials, has been described thoroughly by Dawson [Dawson, P. H. *Quadrupole Mass Spectrometry and its Applications*; AIP Press: Woodbury, N.Y., 1995.] In the central portion of a quadrupole rod array where end effects are negligible, the two-dimensional quadrupole potential can be written as $$\phi = \phi_0 \frac{x^2 - y^2}{r_0^2} \tag{1}$$

where $2r_0$ is the shortest distance between opposing rods and $\phi_0$ is the electric potential, measured with respect to ground, applied with opposite polarity to each of the two poles. Traditionally, $\phi_0$ has been written as a linear combination of DC and RF components as $$\phi_0 = U - V \cos \Omega t \tag{2}$$

where $\Omega$ is the angular frequency of the RF drive and U and V are respectively the DC and RF components.

In response to the potential described by Eq. 2, the equation of motion for a singly charged positive ion of mass m is $$\frac{d^2 \bar{r}}{dt^2} = -\frac{e}{m} \nabla \phi \tag{3}$$

where e is the electronic charge and m the mass of an ion. With the substitution of the dimensionless parameter $$\xi = \frac{\Omega t}{2} \tag{4}$$

Figure 1:
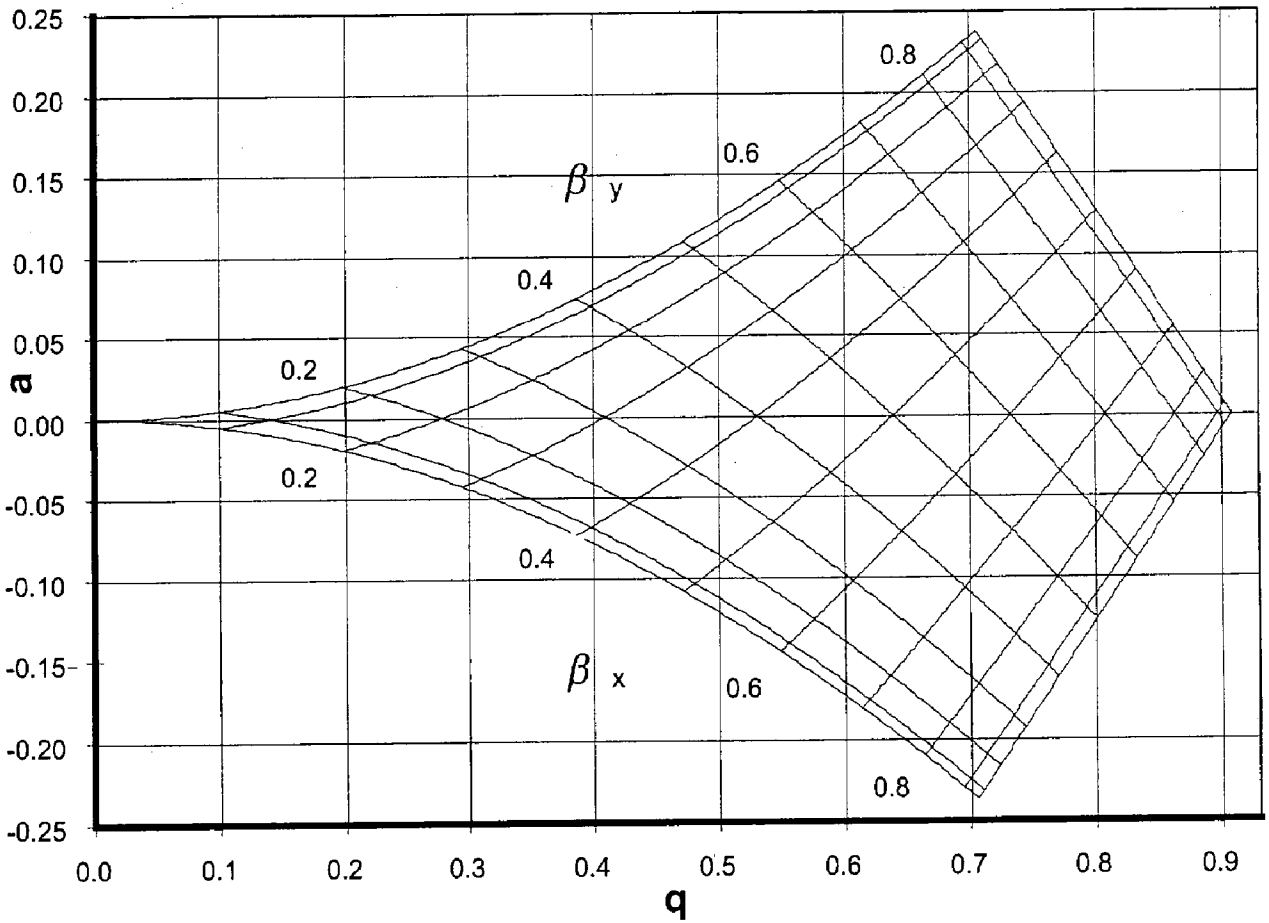
FIG. 1 is a graph showing the stability region of a quadrupole instrument.

Eq. 3 can be cast in Mathieu form as $$\frac{d^2 u}{d\xi^2} + (a_u - 2q_u \cos 2\xi)u = 0 \tag{5}$$

where u can be either x or y and $$a_u = \pm \frac{8eU}{mr_0^2\Omega^2} \tag{6}$$

and $$q_u = \pm \frac{4eV}{mr_0^2\Omega^2} \tag{7}$$

where the + and − signs correspond to u=x and u=y, respectively. For ions to maintain stable trajectories within the quadrupole rod set the a- and q-parameters must fall within a particular range of values that can be mapped graphically as the first region of stability as shown in FIG. 1.

Figure 2:
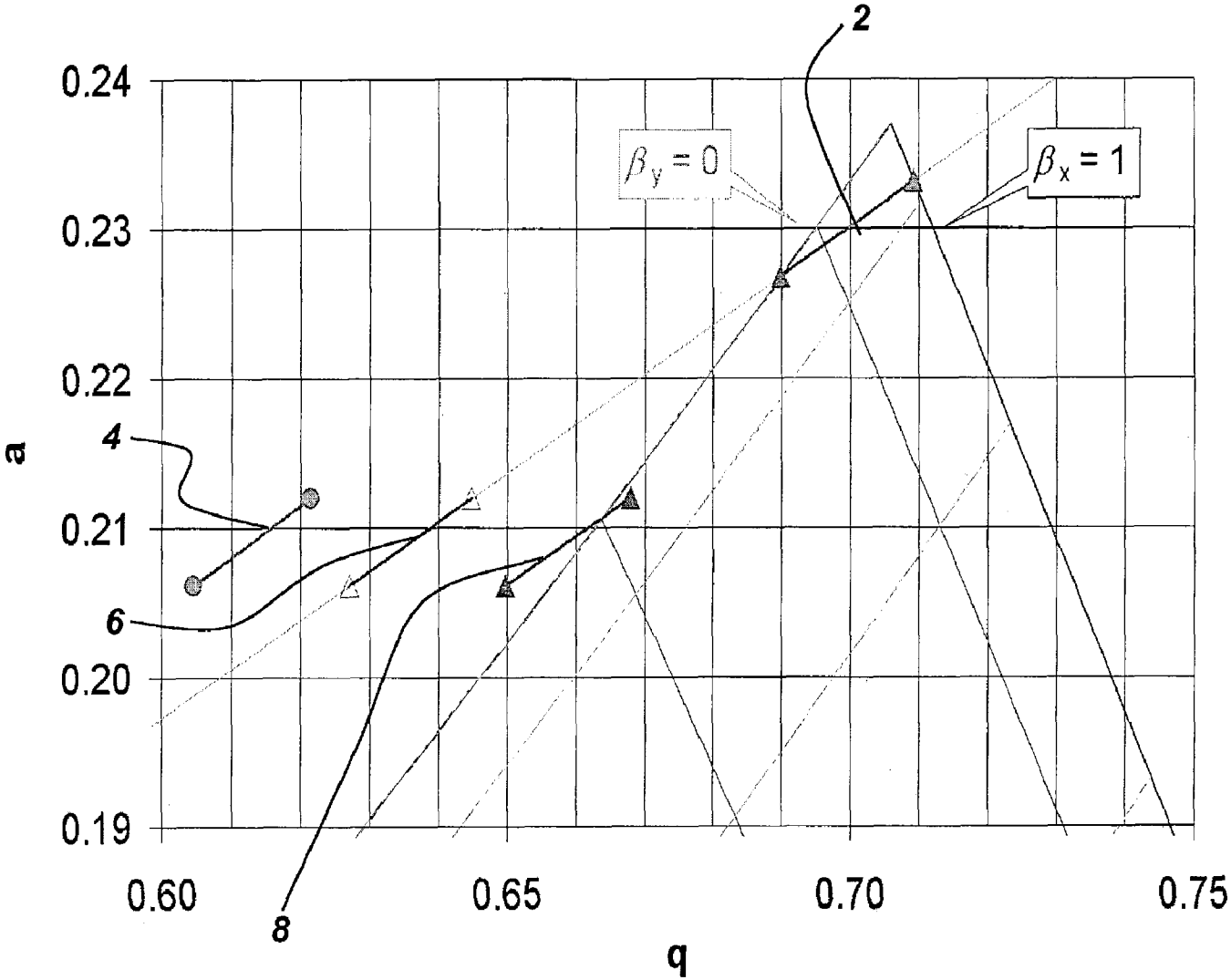
FIG. 2 is a simplified diagram of the stability region as shown in FIG. 1.

When the RF voltage is balanced between poles, then as the quadrupole field diminishes in the fringing region, the segment of the scan line, on which ion trajectories are stable, which will be identified as a segment of stability, moves along the scan line toward the origin crossing the $\beta_y=0$ stability boundary. Typically, there are positions within fringing regions where the segment of stability is transformed to coordinates, which lie outside of the first stability region completely, as is shown in FIG. 2. As a result, ion trajectories are unstable during the time that it takes for them to travel through this portion of the fringing region, and consequently, some are lost.

In FIG. 2, this segment of stability is indicated at 2 for conventional operation away from the ends of the rods. Consider for example, a point in the x-z plane, which is inside the rod array, $0.25r_0$ from the ends of the rods, with $x=0.5r_0$. At this point, the segment of stability is variously indicated at 4,6,8. Segment 4 indicates its position for potential ratio of the RF voltage X:Y=85:115; segment 6 indicates the position for equal potentials on the X and Y rods, i.e. a ratio X:Y=100:100; segment 8 indicates the position for a potential ratio of the RF voltage X:Y=115:85.

Further, the width of the distribution of axial energies of a population of ions is increased when those ions are transmitted through a fringing field. This condition holds for both entrance and exit, and for both RF-only and RF/DC fringing fields.

The degree of broadening in the distribution of axial energies, experienced by a population of ions, when those ions are transmitted through a fringing field, increases strongly with the degree of RF voltage unbalance. For example, when the configuration is balanced, X:Y=100:100, axial distributions are broadened by about 50%. When X:Y=85:115, axial distributions are broadened by about one order of magnitude. Over the range of X:Y ratios studied here, 100:100 to 85:115, the increase in the width of the distribution of axial energies of a population of ions after traversing a fringing field was a linear function of the pole balance fraction.

It has been observed experimentally that the intensity, and to a lesser extent the quality, of RF/DC mass spectral peaks, especially at high m/z can be improved when a Q3 RF tank circuit is tuned off balance. Specifically, the greatest intensity is achieved when A-pole is low, relative to B-pole and this relationship has been demonstrated for a ratio of RF levels as great as X:Y=0.85:1.15. It is noteworthy that A-pole carries positive DC during RF/DC operation and that the auxiliary dipolar excitation, used to effect mass-selective axial ejection, is applied between the A-pole rods. Furthermore, the ratio of RF levels between poles is manifest only in the fringing regions near the ends of the rods where the lens elements provide a reference to RF ground.

The improved sensitivity of RF/DC filters when the RF amplitude is lower on the pole that carries the positive quadrupolar DC can be understood by examining the consequences to the scan line near the apex of stability. Because the quadrupolar DC remains balanced regardless of the tuning of the RF coil, the slope of the scan line in the fringing region will differ in the x-z and y-z planes when the RF is unbalanced. Specifically, if A-pole is RF-low, the slope of the scan line will increase in the x-z plane and decrease in the y-z plane.

Figure 3:
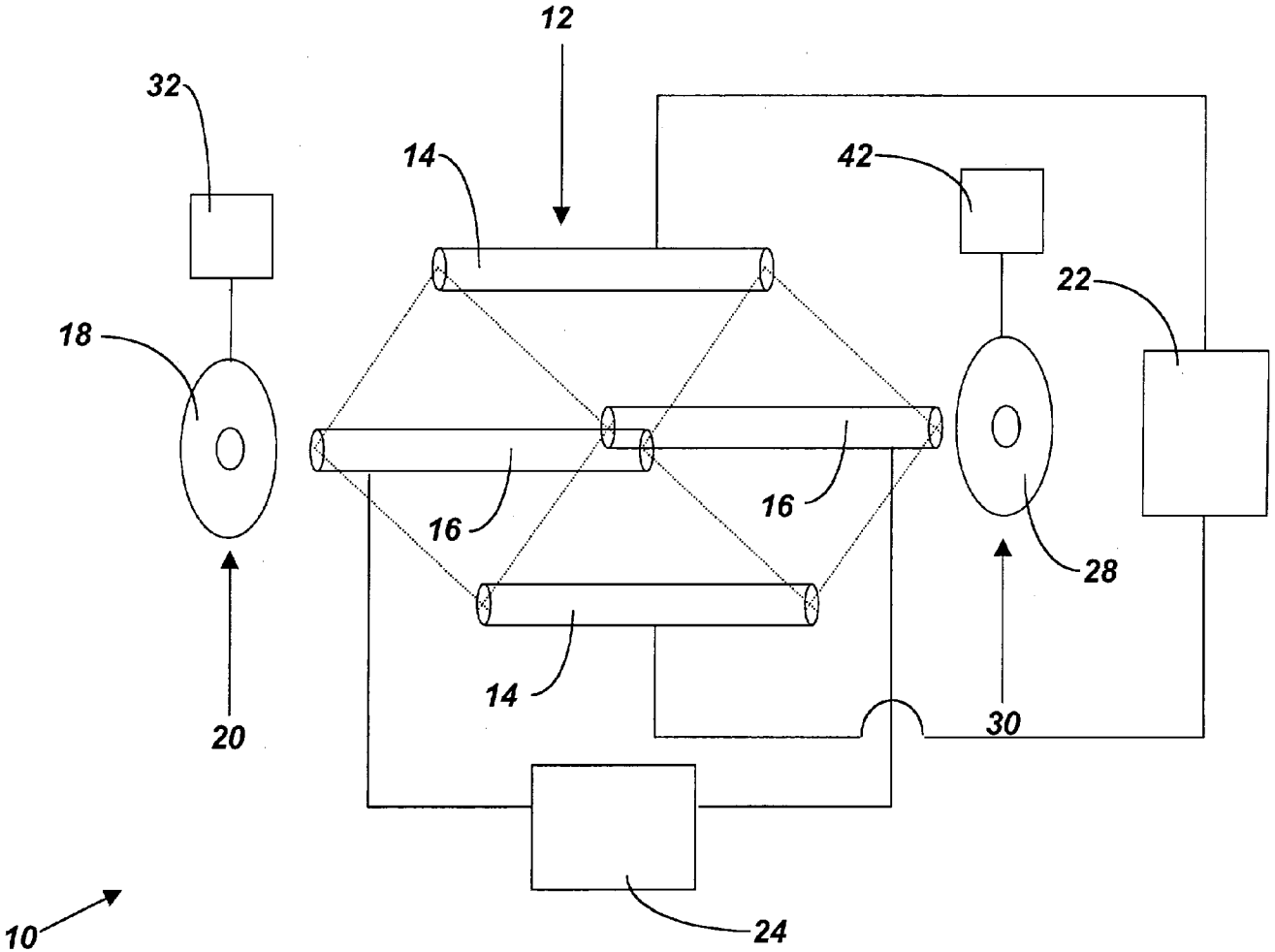
FIG. 3 shows a system for producing a modifiable fringing field in a multipole instrument, according to the teachings of the present invention.

FIG. 3 shows a system 10 for producing a modifiable fringing field in a multipole instrument. For example, the multipole instrument can include one of an RF/DC mass spectrometer, an RF-only mass spectrometer, an ion trap mass spectrometer, and an ion guide. The system includes a rod set or conductor arrangement 12 having a first pole pair 14, a second pole pair 16 and an end device 18 near an end 20 of the first pole pair 14 and the second pole pair 16. For example, the end device 18 can be an end plate or lens. The system 10 further includes a first power supply 22, a second power supply 24 and a first end device power supply 32. In addition to the first end device 18, the system 10 can include a second end device 28 near the other end 30 of the first pole pair 14 and the second pole pair 16. For example, the second end device 28 can be an end plate or lens. The end device 18 can be an entrance device or an exit device. If the end device 18 is an entrance device, then the second end device 28 is an exit device, and if the end device 18 is an exit device, then the second end device 28 is an entrance device. The system 10 can also include a second end device power supply 42. In many cases, it will be possible to integrate the power supplies 22, 24, 32 and 42.

By way of example, in FIG. 3, the first end device 18 is an entrance lens, which has an 8 mm mesh covered aperture to allow ions to enter the rod set 12, and the second end device 28 is an exit lens, which likewise can have an 8 mm mesh covered aperture to allow ions to exit the rod set 12. The end devices 18 and 28 also function to terminate the quadrupolar fields.

The first power supply 22 applies a first voltage to the first pole pair 14, while the second power supply 24 applies a second voltage to the second pole pair 16.

Likewise, the application of the first and second voltages results in a fringing field near the entrance device 18. The first end device power supply 32 applies a first end device voltage to the entrance device 18 for modifying the first fringing field to facilitate the entrance of the ions. The application of the first and second voltages in the presence of the exit lens 18 gives rise to another fringing field near the exit lens 28. The end device power supply 42 applies a second end device voltage to the exit lens 28 for modifying the fringing field to facilitate the exit of the ions, as described in more detail below.

The first fringing field and the second fringing field can be modified independently. Moreover, the fringing fields can be modified without substantially altering the first voltage or the second voltage. Thus, the first voltage and the second voltage can be optimized to meet whatever requirements are necessary, without regard to the effects on the fringing fields. Then, the fringing fields can be independently altered without affecting the optimum first and second voltages applied to the rod set 12.

In FIG. 3, the first pole pair 14 includes two conducting rods and the second pole pair 16 also includes two conducting rods. All four rods are substantially parallel. The rods can be cylindrical or can have a cross section a part of which describes a hyperbola. The four rods are substantially equal in length. The two rods of the first pole pair 14 lie on opposite edges of a fictitious box, and the two rods of the second pole pair 16 lie on the other opposite edges of the box.

FIG. 3 shows a system 10 for producing a modifiable fringing field in an ion trap mass spectrometer. The system 10 can also be used in other multipole instruments, such as an RF/DC mass spectrometer, an RF-only mass spectrometer, and an ion guide.

For the ion trap mass spectrometer, the first voltage that is applied to the first pole pair 14 is a first RF voltage and the second voltage that is applied to the second pole pair 16 is a second RF voltage, the first and second voltages being out of phase by 180°. In addition, a DC rod offset voltage is applied to all the rods. A trapping DC voltage is also applied to the exit lens 28, although no resolving DC voltage need be applied to the rods for the ion trap mass spectrometer. For an RF/DC mass spectrometer, the first voltage includes a first DC resolving voltage, and the second voltage includes a second DC resolving voltage, as known to those of ordinary skill.

To control the fringing field near the exit lens 28, the end device voltage applied to the exit lens 28 is an end device RF voltage that is in phase with the first voltage. The end device voltage modifies the fringing field to impart greater axial kinetic energy to the ions to facilitate the exit of the ions and thereby improve the sensitivity of the multipole instrument.

Figure 4:
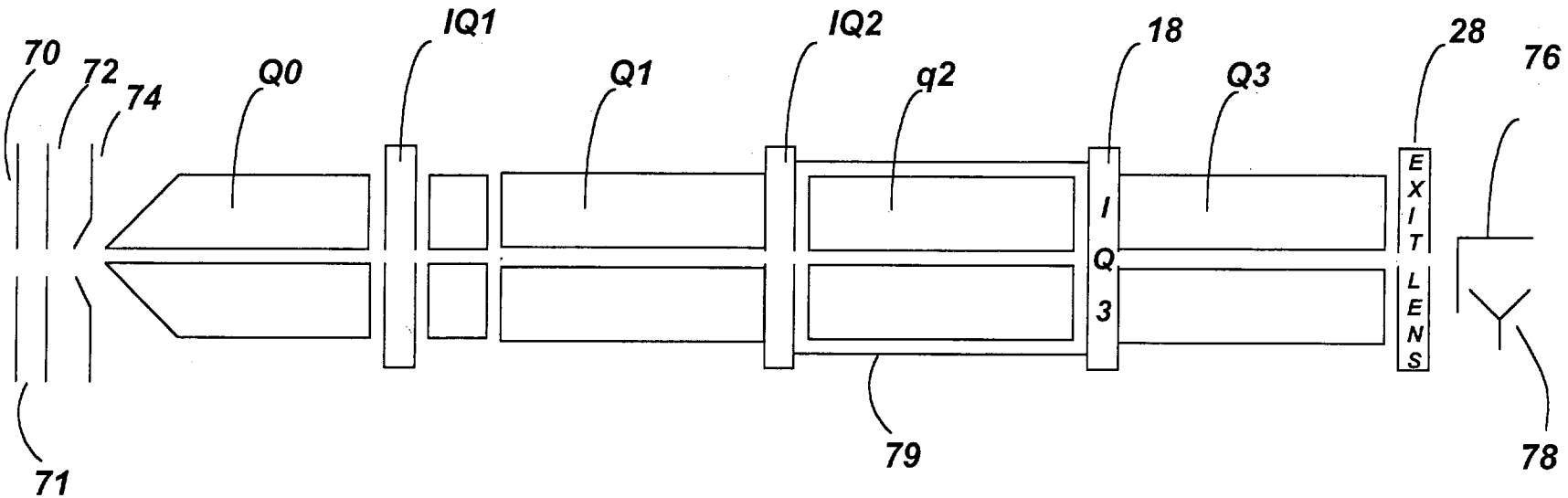
FIG. 4 shows a diagrammatic view of an apparatus that includes a system for producing and modifying a fringing field in an ion trap mass spectrometer, according to the teachings of the present invention.

FIG. 4 shows a diagrammatic view of an apparatus 68 that includes a system 10 for producing and modifying a fringing field in an ion trap mass spectrometer. The apparatus 68 includes a version of the Q TRAP instrument (Applied Biosystems/MDS SCIEX, Toronto, Canada) with a Q-q-Q linear ion trap arrangement. The apparatus 68 includes a curtain gas entrance plate 70, a curtain gas and differential pumping region 71, a curtain gas exit plate 72, a skimmer plate 74, a Brubaker lens 75, and four sets of rods Q0, Q1, q2 and Q3. The apparatus 68 further includes end interquad apertures or lenses IQ1 between rod sets Q0 and Q1, IQ2 between Q2 and Q3, and IQ3 (also identified as entrance lens 18) between Q2 and Q3, as well as the exit lens 28, a deflector lens 76 and a detector (a channel electron multiplier) 78. The lenses IQ1, IQ2 and IQ3 have orifices or apertures to allow ions to pass therethrough, in known manner.

Following conventional triple quadrupole operation, the first quadrupole rod set Q1 is configured for operation as a mass analyzer to select ions of desired mass/charge ratio. These ions then pass into the second rod set Q2, which is configured and enclosed, as indicated at 79, to operate as a collision cell. Fragment ions formed in the collision cell of Q2 are then mass analyzed with the final rod set Q3 and detector 78.

In accordance with FIG. 3, the final quadrupole rod array Q3 contains the first pole pair 14 and the second pole pair 16 (not shown in FIG. 4), and is configured to operate as a linear ion trap with mass-selective axial ejection. In another embodiment, the final quadrupole rod set Q3 is configured as a conventional RF/DC mass filter.

For operation in the first mode identified above, i.e. a linear ion trap, the applied DC voltages are ground at skimmer plate 74, −10 volts DC at Q0, −11 volts DC at IQ1, −11 volts at Q1, −20 volts at IQ2, −20 volts DC at Q2, −21 volts DC at IQ3, −30 volts DC on Q3, and 0 volts on the exit lens 28. No resolving DC voltages are applied to the quadrupoles.

A suitable ion source, for example a pneumatically assisted electrospray ion source (not shown), injects ions through the entrance plate 70 and into the curtain gas and differential pumping region 71. The ions leave the curtain gas exit plate 72 to enter the RF-only quadrupole guide Q0 located in a chamber maintained at approximately $6\times10^{-3}$ torr. The Q0 rods are capacitively coupled to a 1 MHz source (not shown), for the Q1 ion set drive RF voltage. The interquad aperture, or lens IQ1, separates the Q0 chamber and the analyzer chamber from rod set Q1. A short RF-only Brubaker lens 75, located in front of the Q1 RF/DC quadrupole mass spectrometer, is coupled capacitively to the Q1 drive RF power supply.

The rod set Q2 of collision cell 79 is located between the lenses IQ2 and IQ3. Nitrogen gas is used as the collision gas. Gas pressures within Q2 are calculated from the conductance of IQ2 and IQ3 and the pumping speed of turbo molecular pumps. Typical operating pressures are about $5\times10^{-3}$ torr in Q2 and $3.5\times10^{-5}$ torr in Q3. The RF voltage used to drive the collision cell rods Q2 is transferred through a capacitive coupling network, from a 1.0 MHz RF power supply for rod set Q3.

The Q3 quadrupole rod set is mechanically similar to Q1. Downstream of Q3, the apparatus 68 includes the exit lens 28, which contains a mesh covered 8-mm aperture, and the deflector lens 76, which includes a clear 8-mm diameter aperture. Typically, the deflector lens 76 is operated at about 200 volts attractive with respect to the exit lens 28 to draw ions away from the Q3 ion trap toward the ion detector 78.

The detector 78 can be an ETP (Sydney, Australia) discrete dynode electron multiplier, operated in pulse counting mode, with the entrance floated to −6 kV for positive ion detection and +4 kV for detection of negative ions.

In operation, a short pulse of ions is allowed to pass from Q0 into Q1 by changing the DC lens voltage on IQ1 from +20 volts (which stops ions) to −11 volts (for ion transmission). Here, both Q1 and Q2 act as simple ion guides. Ions are trapped in Q3 by the relatively high potential on the exit lens and are then scanned out axially by ramping the RF applied to the Q3 rods, typically from 924 volts peak to peak to 960 volts peak to peak. Q3 is then emptied of any residual ions by reducing the RF applied to its rods to a low voltage, typically 10 volts peak to peak. Axial ejection of ions often takes place by applying an auxiliary dipolar AC field to Q3 at a frequency of 380 kHz and an amplitude of approximately 1 volt and then scanning the RF voltage. The sequence is then repeated.

Figure 5:
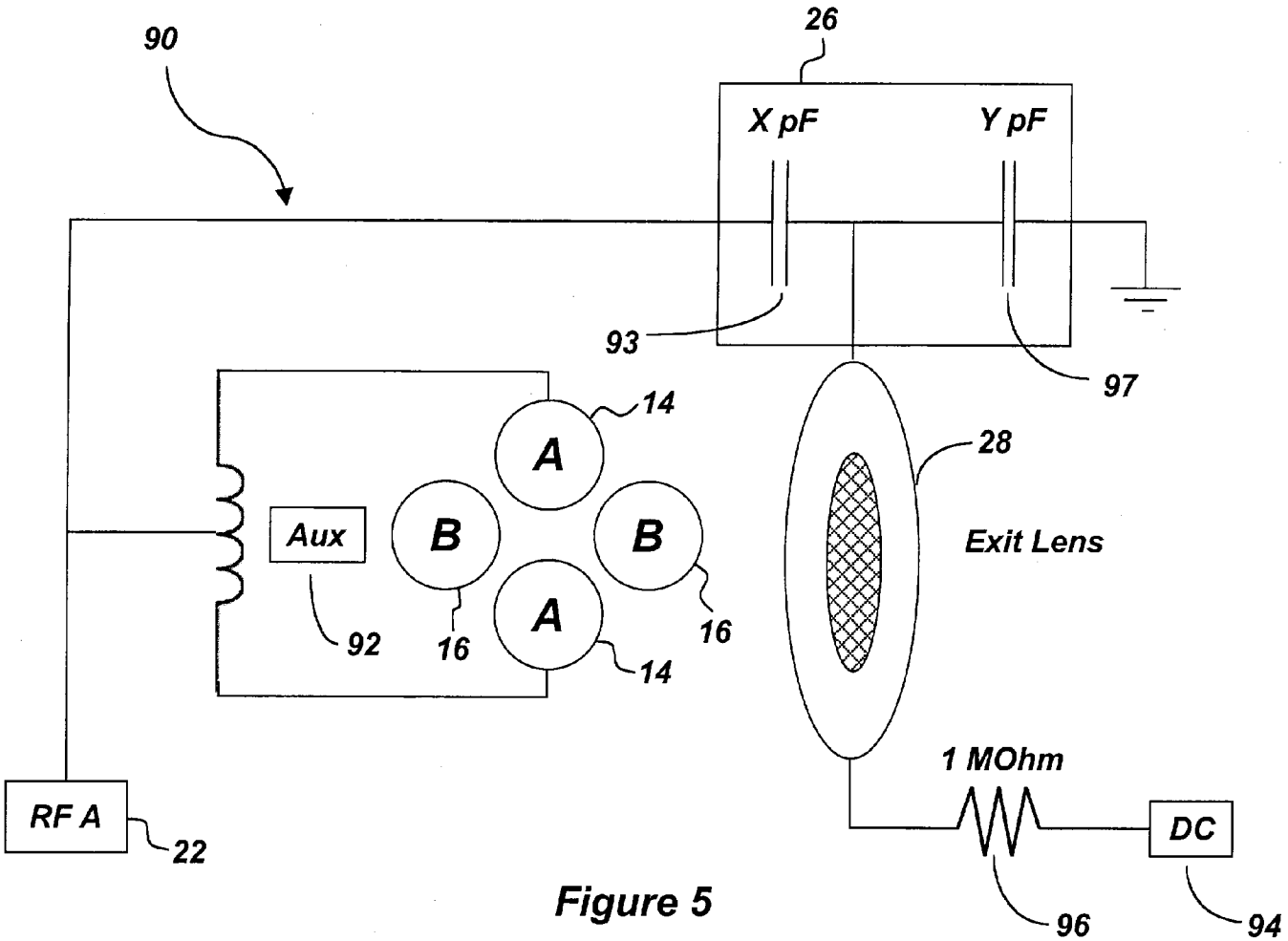
FIG. 5 shows a circuit used to apply an RF voltage to the exit lens of FIG. 3.

FIG. 5 shows a circuit 90 used to apply the RF voltage to the exit lens 28. A similar circuit can be used to provide an RF voltage to the IQ3 entrance lens 18, or a similar hybrid circuit can be used to provide an RF voltage to both the entrance lens 18 and the exit lens 28. The circuit 90 shows the first pole pair 14, the second pole pair 16, an auxiliary power supply 92, the RF first power supply 22, the exit lens 28, a DC power supply 94, a resistor 96, and the end device power supply 26, which contains an X capacitor 93 and a Y capacitor 97 (X and Y here having no relation to the x and y axes of the quadrupole).

The first RF power supply 22 provides a first RF voltage to the first pole pair 14. A second RF power supply (not shown) similarly provides a second RF voltage to the second pole pair 16. The auxiliary power supply 92 supplies an auxiliary AC voltage to the first pole pair 14 to axially eject ions from the region between the first pole pair 14 and second pole pair 16. The auxiliary AC is added to the RF through a transformer. The DC power supply 94 supplies a DC voltage to the exit lens 18 via the one Mohm resistor so that additional RF does not appear in the power supply.

The end device power supply 26 supplies the end device voltage to the exit lens 28. The end device voltage is an RF voltage that is in phase with the first RF voltage. Thus, it is convenient, as shown in FIG. 5, to tap the first power supply 22 to provide the power for the end device power supply 26. The X capacitor 93 (with capacitance X) and the Y capacitor 97 (with capacitance Y) form part of a capacitive dividing network that dictates the fraction of the RF amplitude driving the first pole pair that is delivered to the exit lens 28. In particular, a fraction X/(X+Y) of the RF amplitude driving the first pole pair is delivered to the exit lens 28.

If there is an entrance lens 18 (not shown in FIG. 3), a fourth power supply 32 (not shown) provides an RF voltage to the entrance lens 18. Again this can be a capacitive dividing network. Then, the voltages applied to the first pole pair 14, the entrance lens 18 and the exit lens 28 are all in phase. However, the amplitudes of these three voltages are generally not the same. As discussed in more detail below, it is by varying the amplitudes of the RF voltages to the entrance lens 18 and the exit lens 28 that the resultant fringing fields near these lenses can be independently modified. The capacitances of the capacitors 93 and 97 in the end device power supply 26 can be varied to vary the amplitude of the end device voltage supplied to the exit lens 28, as described above.

Figures 6A, 6B:
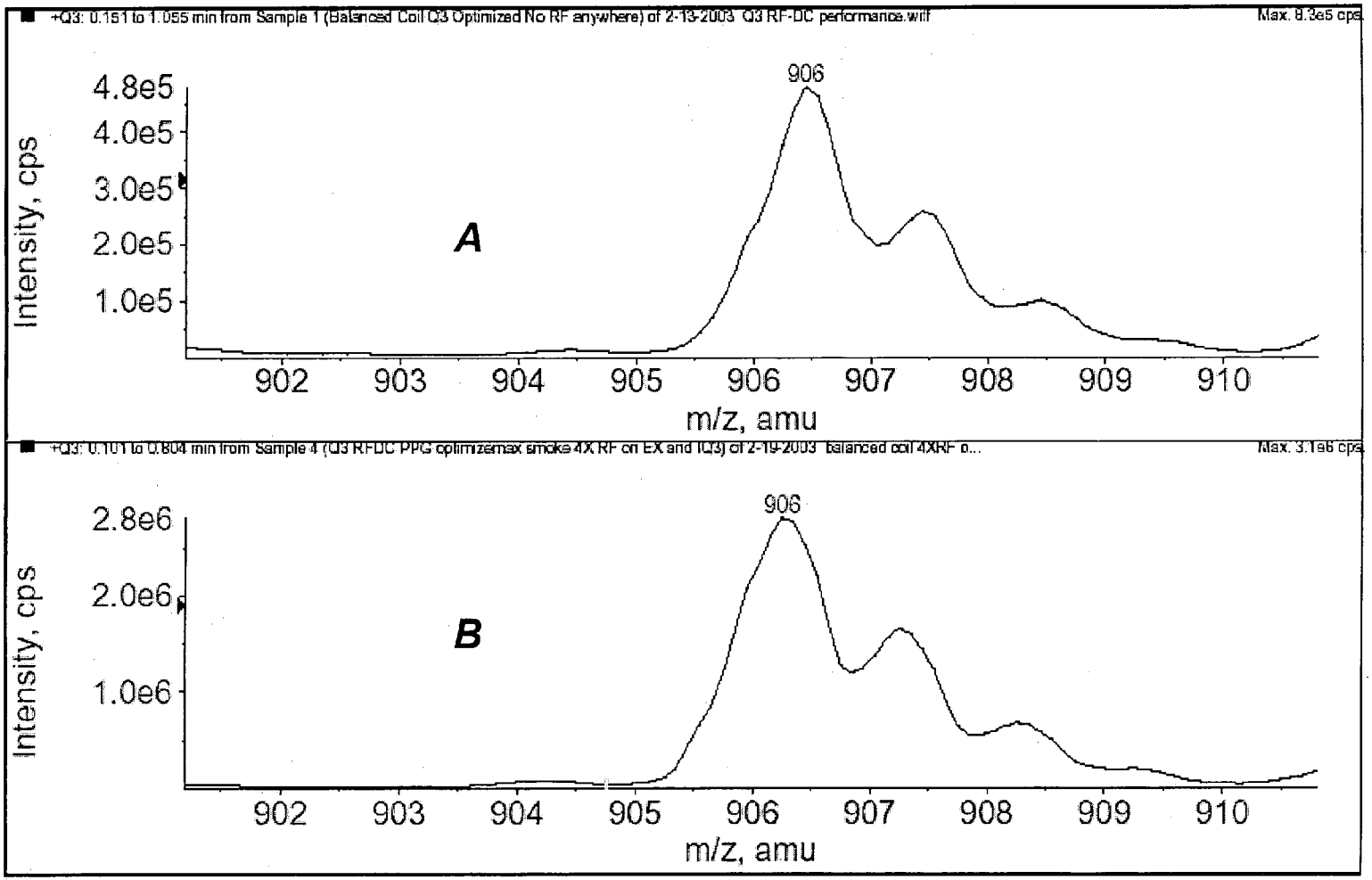
FIGS. 6A and 6B are spectra demonstrating the impact of adding an RF voltage to the entrance lens of FIG. 3.

FIGS. 6A and 6B are spectra demonstrating the impact of adding an RF voltage to the IQ3 entrance lens 18. Both spectra are for polypropylene glycol at m/z=906. FIG. 6A is a spectrum obtained with no RF added to the IQ3 entrance lens 18, and equal RF voltage amplitudes supplied to the first pole pair 14 and to the second pole pair 16. FIG. 6B, is a spectrum obtained with approximately 15% of the drive RF supplied to the IQ3 entrance lens 18 using a circuit similar to the one in FIG. 5. That is, the amplitude of the end device RF voltage is 15% of the amplitude of the first voltage and is phase-synchronous with the first voltage. The first and second voltages are of equal amplitude, but their phases differ by 180 degrees. The peak ion intensity in FIG. 6B is advantageously about six times that in FIG. 6A.

As described in U.S. Pat. No. 6,028,308 by Hager for an RF-only transmission mass spectrometer, by applying different RF amplitudes to the first pole pair 14 and the second pole pair 16 of an RF/DC mass spectrometer, resulting in an "unbalanced" configuration, the fringing field near the exit lens can be modified advantageously. An understanding of how unbalancing the voltage amplitudes applied to the pole pairs can lead to a modification of the fringing fields sheds light on how to control the fringing fields by applying an RF voltage to the end devices 18 and 28.

The fringing fields can be modified by making changes to the RF or DC voltages applied to the rods. For example, changes in the relative amounts of RF voltage on the two pole pairs of a quadrupole rod array can lead to profound changes in both the entrance and exit fringing fields. However, when there is no reference to RF ground, the RF voltage ratio between the two pole pairs is irrelevant. This is the case within the multipole structure sufficiently distant from the rod ends, such as in the central section of a linear multipole. There is a reference to RF ground in the entrance and exit fringing fields provided by the entrance and exit lenses. Under these conditions, the relative RF voltage ratio on the pole pairs of the multipole array is meaningful and can strongly affect the performance of multipole ion guides, RF/DC mass spectrometers, RF-only mass spectrometers, and mass selective linear ion trap mass spectrometers.

During operation of a RF/DC quadrupole, ions tend to become linearly polarized between the rods of the pole, which carries the negative quadrupolar DC. That is, if the first pole pair, lying on the x-axis, carries the positive quadrupolar DC, positive ions tend to polarize in the y-z plane, where z is the axial direction. Although this tendency is detectable in the central portion of the quadrupole where the electric field has no axial component, it is manifest most strongly in the fringing regions at the entrance and exit ends of quadrupole arrays.

The width of the distribution of axial energies of a population of ions travelling through a mass spectrometer is increased when those ions are transmitted through a fringing field. This conditions holds for both entrance and exit, and for both RF-only and RF/DC fringing fields.

The degree of broadening in the distribution of axial energies, experienced by a population of ions, when those ions are transmitted through a fringing field, increases strongly with the degree of RF voltage unbalance. For example, when the configuration is balanced, i.e., X:Y=100:100 where X is the amplitude of the RF voltage applied to the first pole pair assumed to lie on the x-axis and Y is the amplitude of the RF voltage applied to the second pole pair assumed to lie on the y-axis, axial distributions are broadened by about 50%. When X:Y=85:115, axial distributions are broadened by about one order of magnitude. Over the range of X:Y ratios 100:100 to 85:115, the increase in the width of the distribution of axial energies of a population of ions after traversing a fringing field was a linear function of the pole balance fraction.

The intensity and the quality of RF/DC mass spectral peaks, especially at high m/z, can be improved when the Q3 RF coil is tuned off balance. Specifically, the greatest intensity is achieved when the first pole pair (the X-pole) is low, relative to the second pole pair (Y-pole), and this relationship has been demonstrated for a ratio of RF levels as great as X:Y=0.85:1.15. It is noteworthy that the X-pole carries positive DC during RF/DC operation and that the auxiliary AC voltage, used to effect mass-selective axial ejection, is applied between the X-pole rods. Furthermore, the ratio of RF levels between poles is manifest only in the fringing regions near the ends of the rods where the lens elements provide a reference to RF ground.

The improved sensitivity of RF/DC filters when the RF amplitude is lower on the pole that carries the positive quadrupolar DC can be understood by examining the consequences to the scan line near the apex of stability. Because the quadrupolar DC remains balanced regardless of the tuning of the RF coil, the slope of the scan line in the fringing region will differ in the x-z and y-z planes when the RF is unbalanced. Specifically, if the X-pole is RF-low, the slope of the scan line will be increased in the x-z plane and be decreased in the y-z plane.

As discussed above, when there is no reference to ground, the balance condition between RF poles is irrelevant and such is the case in the central 2D section of a linear quadrupole. In the fringing region, however, the exit lens 28 defines RF ground through its power supply. Under these conditions, the balance between poles of the RF is meaningful and impacts mass-selective axial ejection significantly. However, since the zero of potential is arbitrary, adding the same offset to all three elements (X-pole, Y-pole and exit lens) changes nothing. In consequence, subtracting some fraction, for example 15%, from the RF level on the X-pole and increasing the RF level on the Y-pole by an equivalent amount, with the exit lens 28 at ground, is equivalent to simply adding 15% of the balanced RF level to the adjacent lens element. Thus, addition of RF voltage of the appropriate phase to a lens adjacent to a multipole rod array changes the effective RF voltage balance only in the fringing field to which the RF is applied. This allows the entrance and exit fringing fields to be modified independently while maintaining the RF voltage in a balanced configuration.

By applying an RF voltage to end devices, simultaneous, independent optimization of the entrance and exit fringing fields of a multipole rod array can be achieved regardless of the RF voltage ratio applied to the pole pairs. In particular, it is often desirable to operate the RF voltage in a balanced configuration to both transmit and/or trap ions over the greatest ion m/z range. The present invention allows the entrance and exit fringing fields to be modified while maintaining the multipole in an RF voltage balanced configuration. By varying the amplitudes of the RF voltages applied to the entrance lens and the exit lens in an independently controllable manner, the simultaneous optimization of the entrance fringing field for the best RF/DC quadrupole mass spectrometer performance and optimization of the exit fringing field for the best axial ejection linear ion trap mass spectrometer performance can be achieved while maintaining the RF voltage applied to the pole pairs in a balanced configuration.

Figure 7:
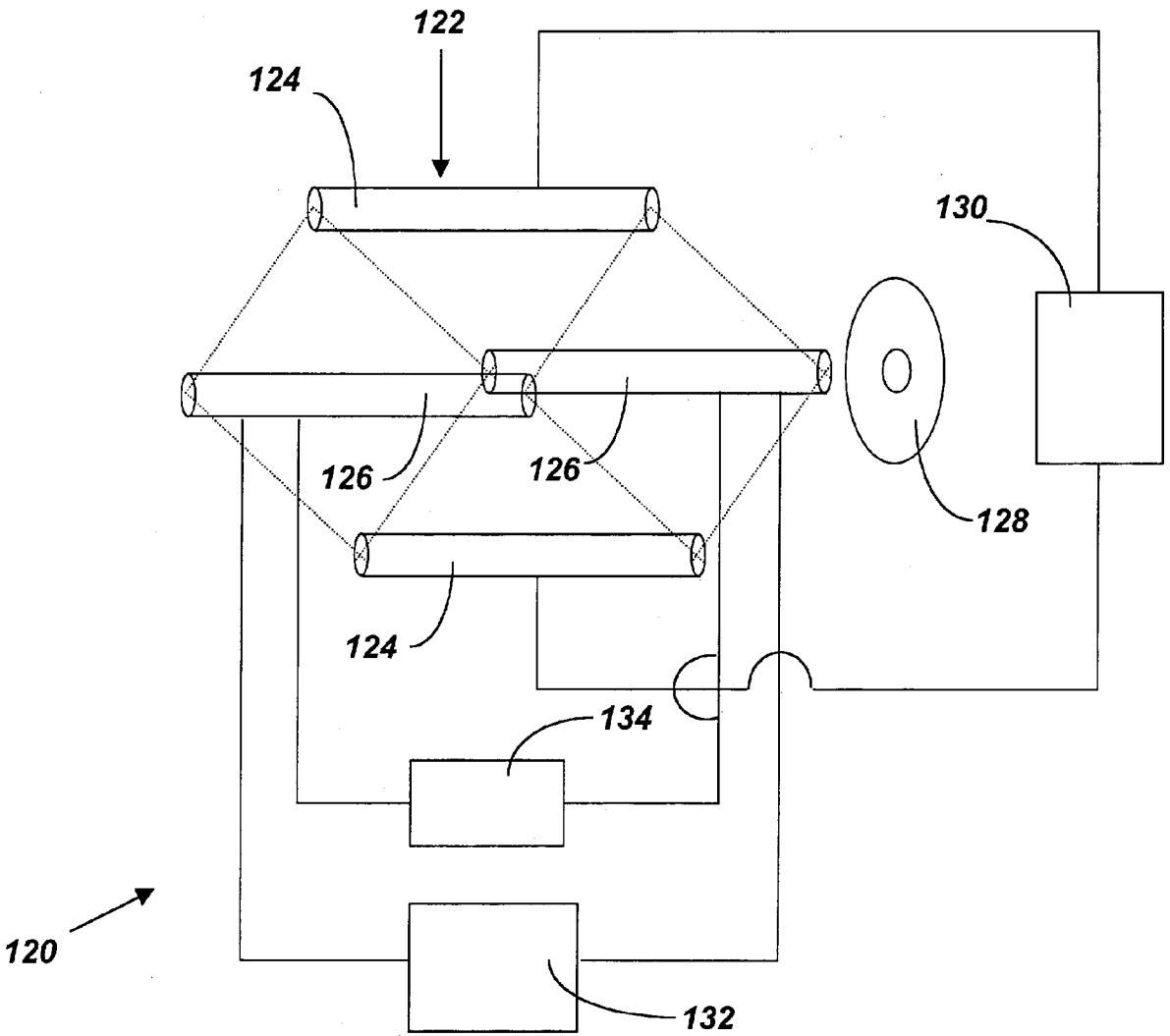
FIG. 7 shows a system for producing a fringing field in an ion trap mass spectrometer, according to the teachings of the present invention.

FIG. 7 shows a system 120 for producing a fringing field in an ion trap mass spectrometer. The system 120 includes a quadrupole rod set 122 having a first pole pair 124, a second pole pair 126 and an end device or lens 128 near an end of the first and second pole pairs 124 and 126. The system 120 further includes a first power supply 130, a second power supply 132 and an auxiliary power supply 134.

The end device 128 allows ions to enter or exit the conductor arrangement 122. The first power supply 130 applies a first RF voltage to the first pole pair 124, while the second power supply 132 applies a second RF voltage to the second pole pair 126. The auxiliary power supply 134 provides an auxiliary voltage, e.g. or AC voltage to the first pole pair 124 to eject ions from an ion trap of the ion trap mass spectrometer. The amplitude of the first voltage is different than the amplitude of the second voltage to thereby produce a fringing field near the end device that facilitates the entrance or exit of the ions.

Figures 8A, 8B, 8C:
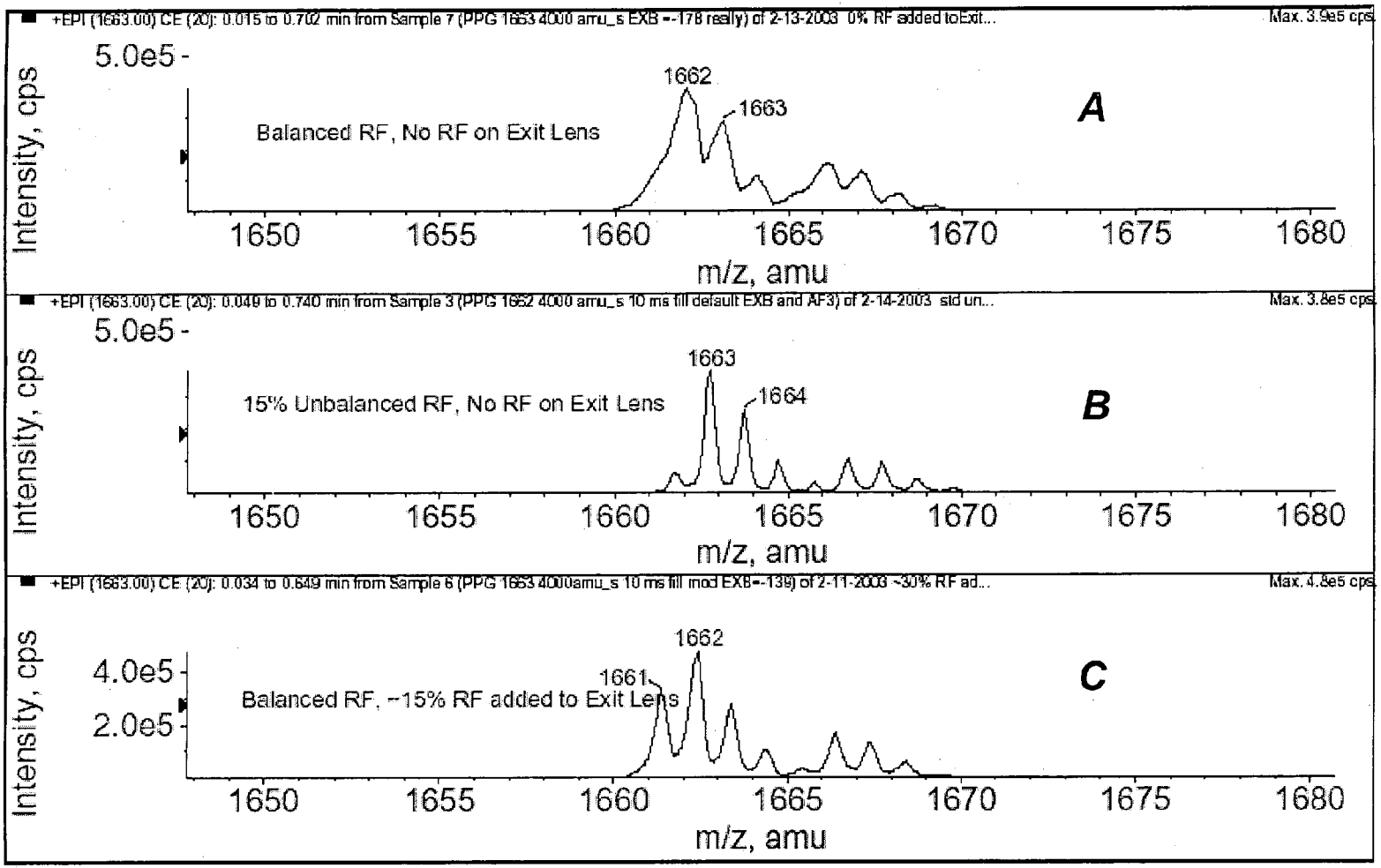
FIGS. 8A–8C show three ion trap mass spectra obtained under three operating conditions.

FIGS. 8A, 8B and 8C show three ion trap mass spectra obtained under three different operating conditions. FIG. 8A was obtained with a balanced RF configuration and no RF added to the exit lens 128. FIG. 8B was obtained by operating with unbalanced RF voltage such that the ratio of voltages applied to the A and B poles, i.e. A:B pole ratio, is about 0.85:1.15, but with no RF added to the exit lens 128. FIG. 8C was obtained with a balanced RF configuration, but with 15% of the A pole RF applied to the exit lens 128.

The three spectra in FIGS. 8A–8C are similar in ion intensity, but the last two spectra display considerably better mass resolution than the first. The resolution differences are likely a result of the different forces acting on an axially ejected ion when the exit fringing field has been modified either by operation with unbalanced RF voltage or by addition of appropriately phased RF voltage to the exit lens 128. Experimentally this is seen by the fact that the optimum exit lens voltage required during the axial ejection step increases strongly with addition of the appropriately phased RF to the exit fringing field using either unbalanced RF voltages or by direct application of RF to the exit lens. This exit lens voltage provides a force on the trapped ion that balances in some measure the RF force. The requirement of a more repulsive exit lens voltage is a strong indication that the RF forces acting on the trapped ion have increased. This results, as can be seen in FIGS. 6A–6C, in superior mass spectral performance.

The foregoing embodiments of the present invention are meant to be exemplary and not limiting or exhaustive. For example, although emphasis has been placed on using mass spectrometers, other multipole instruments, such as ion guides, can benefit from the principles of the present invention. The scope of the present invention is only to be limited by the following claims.

Further, as mentioned above, the invention has general applicability to instruments with a variety of multipole rod sets, but is expected to be particularly applicable to quadrupole rod sets. While the term "rod sets" is used, it is to be understood that each "rod" can have any profile suitable for its intended function and has, at least a conductive exterior. Rods that are circular or hyperbolic are preferred.

What is claimed is:

1. A method of operating a multipole ion guide in a mass spectrometer, the method comprising:

(a) providing a rod set including at least a first pole and a second pole, wherein the rod set has first and second ends;

(b) providing a first end device adjacent to the first end of the rod array;

(c) applying a first pole RF voltage to the first pole;

(d) applying a second pole RF voltage to the second pole, wherein the second pole RF voltage is 180° out of phase with the first pole RF voltage and wherein the first pole RF voltage has an amplitude about equal to an amplitude of the second pole RF voltage;

(e) applying a first end device DC voltage to the first end device, thereby producing a first fringing field in the ion guide adjacent the first end of the rod array;

(f) applying a first end device RF voltage to the first end device, wherein the first end device RF voltage is in phase with the first pole RF voltage.

2. The method of claim 1 further including modifying the first fringing field by varying the amplitude of the first end device RF voltage without substantially varying the amplitudes of the first and second RF voltages.

3. The method of claim 1 further including applying a first pole DC voltage to the first pole.

4. The method of claim 3 further including modifying the first fringing field by varying the first pole DC voltage.

5. The method of claim 3 further including applying a second pole DC voltage to the second pole wherein the first pole DC voltage has a magnitude equal to a magnitude of the second pole DC voltage.

6. The method of claim 5 further including modifying the first fringing field by varying the second pole DC voltage.

7. The method of claim 3 further including applying a second pole DC voltage to the second pole wherein the first pole DC voltage has a magnitude greater than a magnitude of the second pole DC voltage.

8. The method of claim 7 further including modifying the first fringing field by varying the second pole DC voltage.

9. The method of claim 1 wherein the first end device is an entrance lens for controlling the entrance of ions into the ion guide.

10. The method of claim 1 wherein the first end device is an exit lens for controlling the exit of ions from the ion guide.

11. The method of claim 1 further including:

(g) providing a second end device adjacent to the second end of the rod array;

(h) applying a second end device RF voltage to the second end device thereby producing a second fringing field in the ion guide adjacent the second end of the rod array, wherein the second end device RF voltage is in phase with the first pole RF voltage.

12. The method of claim 11 further including modifying the second fringing field by varying the amplitude of the second end device RF voltage without substantially varying the first and second pole RF voltages.

13. The method of claim 11 wherein the first end device is an entrance lens for controlling the entrance of ions into the ion guide and the second end device is an exit lens for controlling the exit of ions from the ion guide.

14. The method of claim 11 wherein the first end device is an exit lens for controlling the exit of ions from the ion guide and the second end device is an entrance lens for controlling the entrance of ions into the ion guide.

15. The method of claim 1 further including:

(g) providing a second end device adjacent to the second end of the rod array;

(h) applying a second end device RF voltage to the second end device thereby producing a second fringing field in the ion guide adjacent the second end of the rod array, wherein the second end device RF voltage is in phase with the second pole RF voltage.

16. The method of claim 15 further including modifying the second fringing field by varying the amplitude of the second end device RF voltage without substantially varying the first and second pole RF voltages.

17. The method of claim 15 wherein the first end device is an entrance lens for controlling the entrance of ions into the ion guide and the second end device is an exit lens for controlling the exit of ions from the ion guide.

18. The method of claim 15 wherein the first end device is an exit lens for controlling the exit of ions from the ion guide and the second end device is an entrance lens for controlling the entrance of ions into the ion guide.

19. The method of claim 1 wherein the rod array is a quadrupole having four pole rods and wherein the first pole includes a pair of first pole rods and the second pole includes a pair of second pole rods.

20. The method of claim 19 including positioning the first pole rods opposite on another across an axis of the rod array and positioning the second pole opposite one another across the rod array.

21. The method of claim 19 including positioning the first pole rods and the second pole rods substantially parallel to an axis of the rod array.

22. The method of claim 1 wherein the rod array is a hexapole having six pole rods and wherein the first pole includes three of the pole rods and the second pole includes the other three pole rods.

23. The method of claim 1 wherein the rod array is an octopole having eight pole rods and wherein the first pole includes four of the pole rods and the second pole includes the other four pole rods.

24. A method of producing a modifiable fringing field in a multipole ion guide, the method comprising:

(a) providing a rod set including at least a first pole and a second pole;

(b) providing an end device adjacent one end of the rod array;

(c) applying a first pole RF voltage to the first pole, wherein the first RF pole voltage has a pole RF amplitude;

(d) applying a second pole RF voltage to the second pole, wherein the second pole RF voltage has an amplitude about equal to the pole RF amplitude and the second RF voltage is 180° out of phase with the first pole RF voltage;

(e) applying an end device DC voltage to the first end device, thereby producing a fringing field in the rod array adjacent the one end of the rod array;

(f) applying a variable first end device RF voltage to the end device, wherein the first end device RF voltage is in phase with the first pole RF voltage, thereby allowing the fringing field to be modified by varying the first end device RF voltage.

25. The method of claim 24 further including modifying the first fringing field by varying the amplitude of the first end device RF voltage.

26. The method of claim 24 further including generating the first end device RF voltage by dividing the first pole RF voltage using a voltage divider.

27. The method of claim 26 wherein the voltage divider is a capacitive voltage divider.

28. The method of claim 24 wherein the first pole includes two or more first pole rods and wherein the second pole includes two or more second pole rods, and including positioning each of the first pole rods and the second pole rods substantially parallel to an axis of the rod array.

29. The method of claim 28 wherein the rod set is a quadrupole rod set and wherein the first pole includes two first pole rods and the second pole includes two second pole rods.

30. The method of claim 29 including positioning the first pole rods diametrically opposite one another about the axis of the rod array and positioning the second pole rods diametrically opposite one another about the axis of the rod array.

31. The method of claim 30 including positioning the first pole rods and the second pole rods such that a first plane defined by the axes of the first pole rods and a second plane defined by the axes of the second pole rods are normal to one another.

32. The method of claim 28 wherein rod set is a hexapole and wherein the first and second poles each include three pole rods.

33. The method of claim 28 wherein rod set is an octopole and wherein the first and second poles each include four pole rods.

34. The method of claim 24 further including modifying the fringing field by varying the end device RF amplitude.

35. The method of claim 24 further including applying a first pole DC voltage to the first pole.

36. The method of claim 35 further including modifying the first fringing field by varying the first pole DC voltage.

37. The method of claim 35 further including applying a second pole DC voltage to the second pole wherein the first pole DC voltage has a magnitude about equal to a magnitude of the second pole DC voltage and including varying the first fringing field by varying the second pole DC voltage.

38. The method of claim 35 further including applying a second pole DC voltage to the second pole wherein the first pole DC voltage has a magnitude differing from to a magnitude of the second pole DC voltage and including varying the first fringing field by varying the second pole DC voltage.

39. The method of claim 24 further including:

(g) providing a second end device adjacent to the second end of the rod array;

(h) applying a second end device RF voltage to the second end device thereby producing a second fringing field in the ion guide adjacent the second end of the rod array, wherein the second end device RF voltage is in phase with the first pole RF voltage.

40. The method of claim 39 further including modifying the second fringing field by varying the amplitude of the second end device RF voltage without substantially varying the first and second pole RF voltages.

41. The method of claim 39 wherein the first end device is an entrance lens for controlling the entrance of ions into the ion guide and the second end device is an exit lens for controlling the exit of ions from the ion guide.

42. The method of claim 39 wherein the first end device is an exit lens for controlling the exit of ions from the ion guide and the second end device is an entrance lens for controlling the entrance of ions into the ion guide.

43. The method of claim 24 further including:

(g) providing a second end device adjacent to the second end of the rod array;

(h) applying a second end device RF voltage to the second end device thereby producing a second fringing field in the ion guide adjacent the second end of the rod array, wherein the second end device RF voltage is in phase with the second pole RF voltage.

44. The method of claim 43 further including modifying the second fringing field by varying the amplitude of the second end device RF voltage without substantially varying the first and second pole RF voltages.

45. The method of claim 43 wherein the first end device is an entrance lens for controlling the entrance of ions into the ion guide and the second end device is an exit lens for controlling the exit of ions from the ion guide.

46. The method of claim 43 wherein the first end device is an exit lens for controlling the exit of ions from the ion guide and the second end device is an entrance lens for controlling the entrance of ions into the ion guide.

* * * * *